US006412663B1

(12) United States Patent
Adamson, II et al.

(10) Patent No.: US 6,412,663 B1
(45) Date of Patent: Jul. 2, 2002

(54) CARTON HOLDER

(75) Inventors: Robert G. Adamson, II; Steven G. Taylor, both of Columbus, OH (US)

(73) Assignee: SIG Combibloc Inc., Columbus, OH (US)

( * ) Notice: Subject to any disclaimer, the term of this patent is extended or adjusted under 35 U.S.C. 154(b) by 0 days.

(21) Appl. No.: 09/714,546

(22) Filed: Nov. 16, 2000

(51) Int. Cl.[7] ..... B67D 5/06

(52) U.S. Cl. ..... 222/183; 222/143; 222/321.9; 220/737

(58) Field of Search ..... 222/131, 183, 222/321.9, 143; 220/737

(56) References Cited

U.S. PATENT DOCUMENTS 4,723,689 A * 2/1988 Vallos et al. ..... 222/183

5,462,168 A * 10/1995 Oberhelman et al. ..... 222/183

* cited by examiner

*Primary Examiner*—Philippe Derakshani
(74) *Attorney, Agent, or Firm*—Standley & Gilcrest LLP

(57) ABSTRACT

A holder for receiving a carton of flowable material, wherein a dispenser connector is preferably provided on the holder for the attachment of a pump or other dispensing means. The holder is especially useful for housing large aseptic cartons of flowable foodstuffs, whereby the contents of the carton may be dispensed without repeated handling of the carton. The holder may be configured in various shapes and size to conform to dissimilar cartons, and the dispenser connector may be provided in various locations to properly cooperate with the particular dispensing location of the carton to be held. After placement into the holder and connection of the dispensing device, the carton may be placed on a shelf, or counter for example, where it may remain until emptied. Multiple holders may be releasably joined in a row via connectors affixed to the holder sides.

39 Claims, 9 Drawing Sheets

CARTON HOLDER

BACKGROUND AND SUMMARY OF THE INVENTION

The use of semi-rigid, and often aseptic containers for packaging and dispensing flowable materials has become commonplace. These containers are now commonly used to dispense a variety of foodstuffs, and are likely most readily identified by the general public in the form of juice cartons, which are typically sold in individual serving sizes.

Foodstuff cartons are typically constructed of a semi-rigid outer material layer, such as paperboard, and an aseptic inner layer for preventing contamination of the contents therein. Typically, a portion of the carton is designed to allow for easy penetration by a dispensing device, such as a straw. Additionally, some foodstuff cartons now possesses re-sealable closures that allow the contents of the carton to be preserved for later use or consumption.

Also existing, although not as commonly seen by the general public, are much larger foodstuff cartons which are designed primarily for commercial applications, such as in restaurants and the like. The size and weight of these commercial foodstuff cartons makes repeated handling of the cartons prohibitive. Also, because of the weight of the contents therein, the carton may tend to deform somewhat due to its semi-rigid construction. Therefore, it is desirous that such cartons may be placed on a shelf, a counter, or in a similar storage area, wherein the contents of the carton may be extracted without repeated handling of the carton itself.

The present invention satisfies this need. The carton holder of the present invention provides a housing into which the carton may be easily inserted or extracted. The housing serves to help prevent the outward deformation of the carton, and also provides a flat base for allowing the carton and holder to rest securely on a storage shelf, counter top, or the like. The carton holder of the present invention also contemplates the use of a threaded collar or similar structure for connecting a dispensing apparatus, such as a pump, to the carton. The carton holder of the present invention may also possess a connecting means for allowing a series of carton holders to be joined in a row.

DETAILED DESCRIPTION OF THE PRESENT INVENTION

Figure 1:
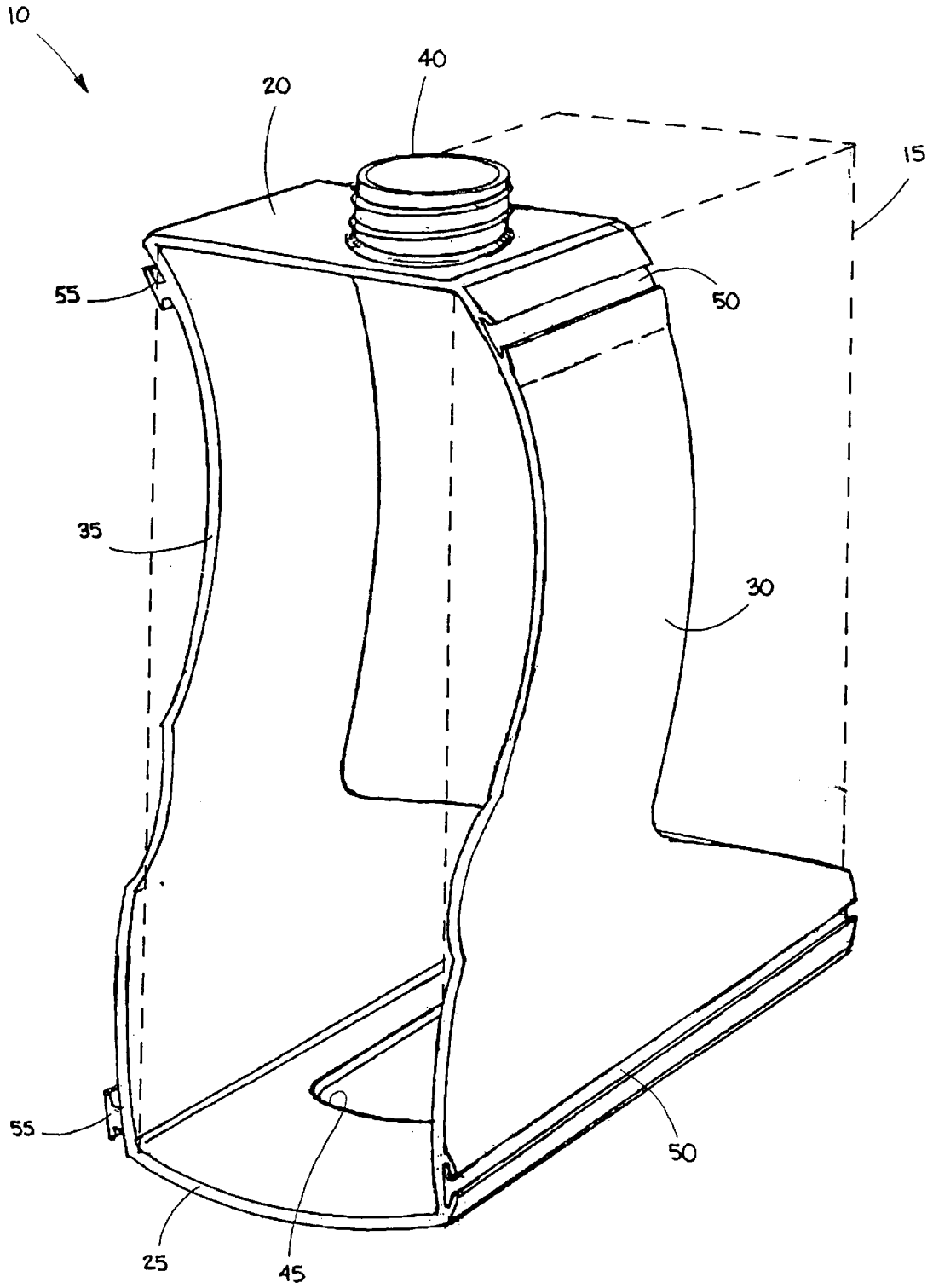
FIG. 1 is a perspective view of one embodiment of a carton holder of the present invention, wherein a carton (shown in phantom) can be seen to reside therein.

A perspective view of one embodiment of the carton holder 10 of the present invention can be seen in FIG. 1. The carton holder 10 is substantially a hollow frame into which a carton 15 may be placed. Although the carton holder 10 may be constructed from a variety of materials, the carton holder is preferably constructed from a plastic material, such as by injection molding.

Figure 2:
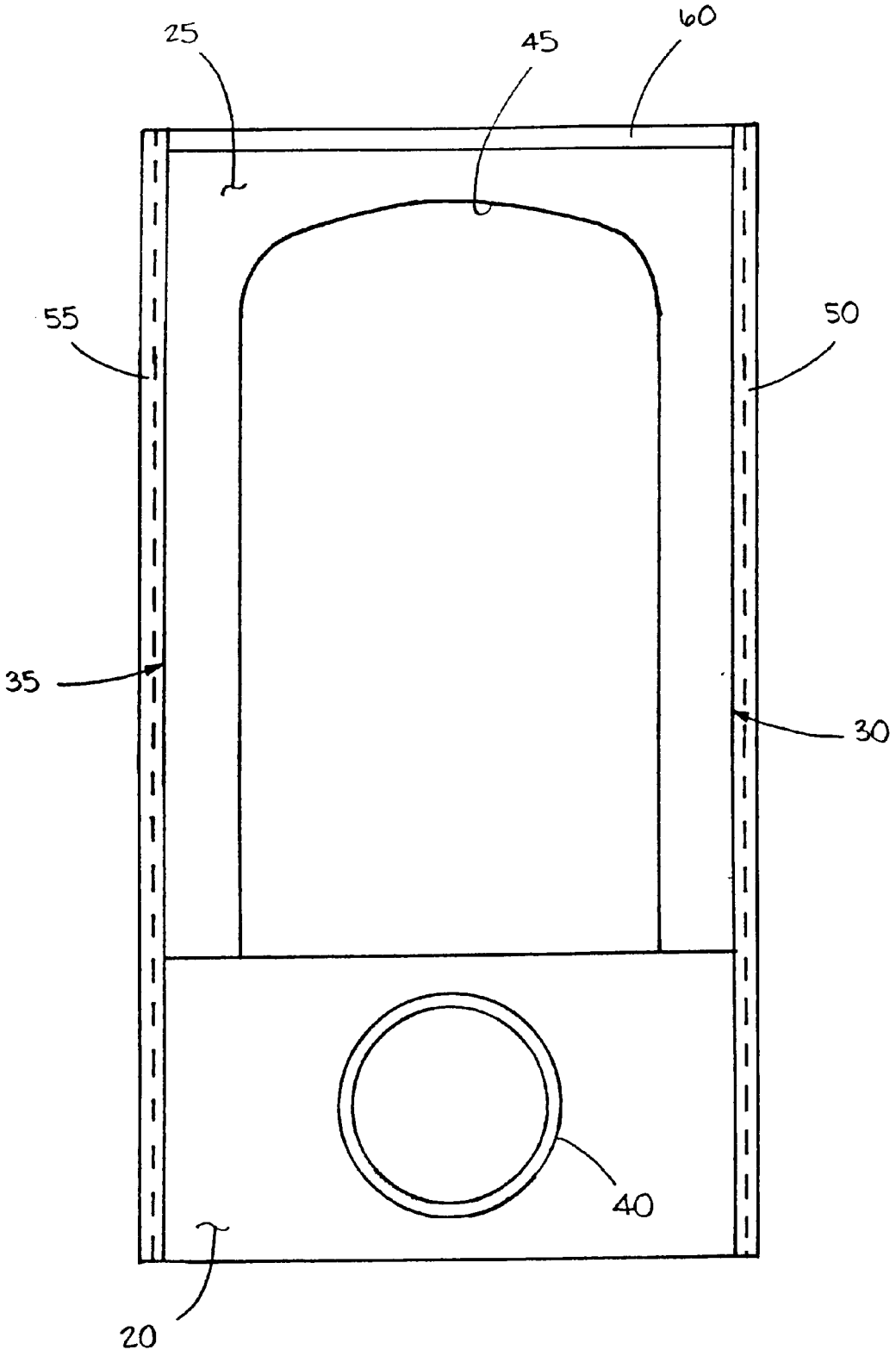
FIG. 2 is a top view of the carton holder of FIG. 1.
Figure 3:
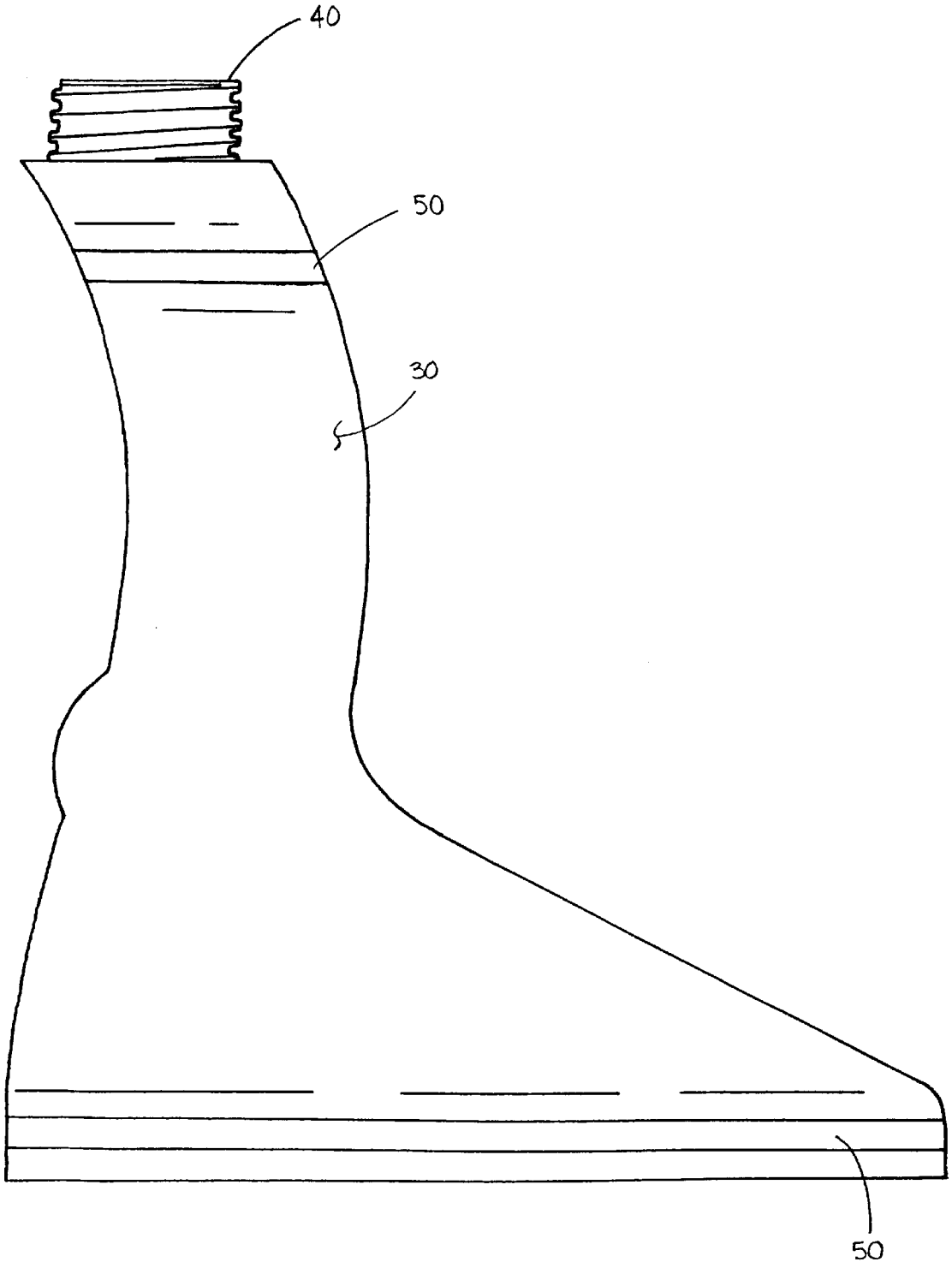
FIG. 3 is a side view of the carton holder of FIG. 1.
Figure 4:
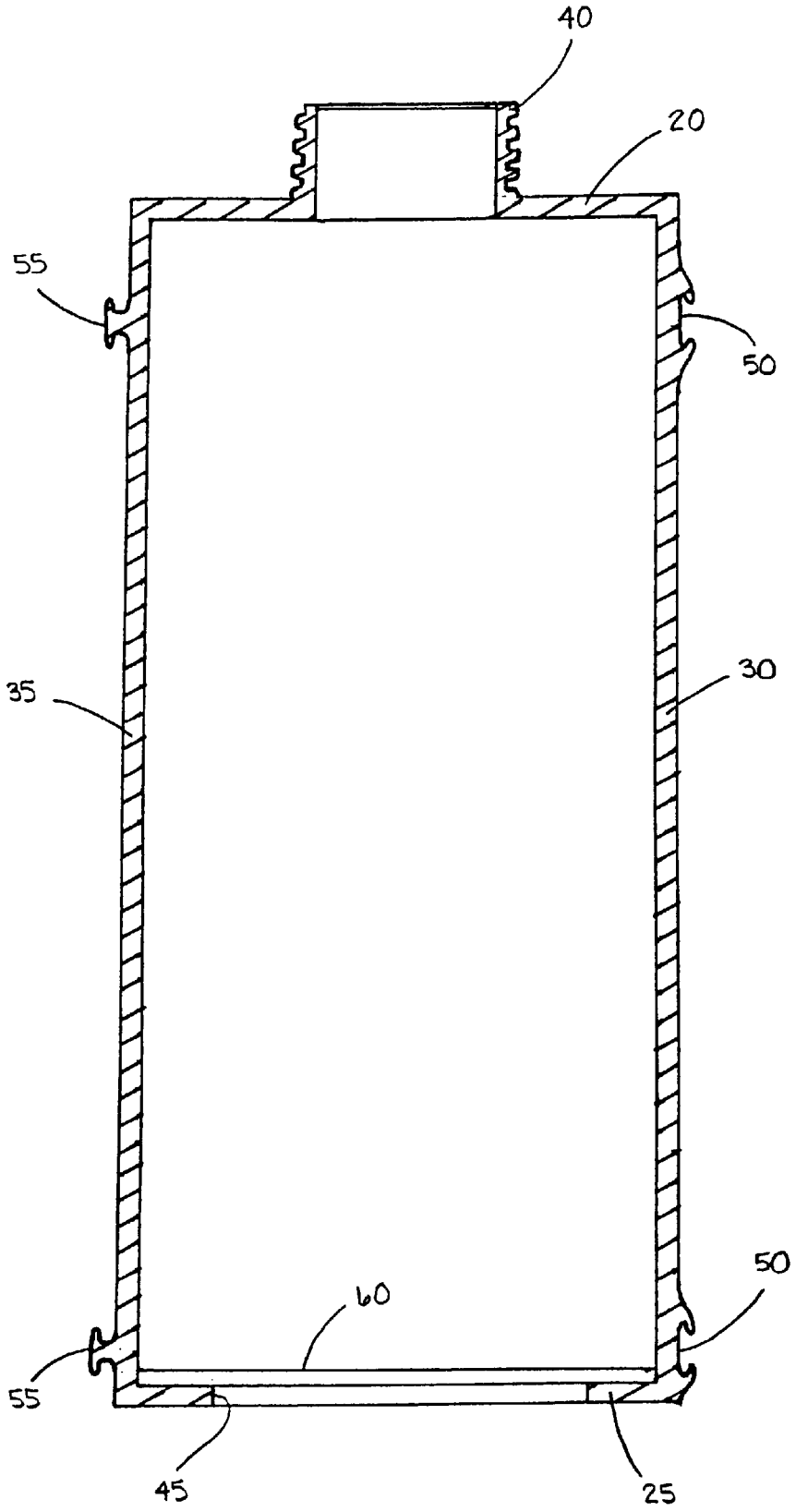
FIG. 4 is a front, cross-sectional view of the carton holder of FIG. 1.

A more detailed construction of the embodiment of the carton holder 10 of FIG. 1 is illustrated in FIGS. 2–4, wherein the carton 15 has been removed for purposes of clarity. As stated above, the carton holder 10 of the present invention comprises a substantially hollow frame for accepting insertion of a carton. The carton holder 10 can be seen to have a top wall 20, to which is connected a base 25 of preferably longer length, via first and second sidewalls 30, 35. The carton holder 10 may also have an opening 45 in the base 25 for aiding in the reduction of the weight and cost of manufacture of the carton holder.

The top 20 is preferably substantially parallel to the base 25, and the first sidewall 30 is preferably substantially parallel to the second sidewall 35, such that a framework of generally rectangular shape is formed. Although in this particular embodiment of the present invention the carton holder 10 is shown to be of rectangular shape, virtually any shape is possible, and other shapes are contemplated by the present invention as dictated by the size and shape of the carton with which the carton holder is to be employed.

A dispenser connector 40 is preferably provided to allow for connection of a pump or other dispensing device to the carton holder 10. Such a dispensing device may be used to remove the contents of the carton 15 without requiring handling of the carton itself. Although the dispenser connector 40 is shown to be formed as part of the top wall 20 in this particular embodiment, as discussed below, the dispenser connector may be placed at other locations on the carton holder 10 as well.

A pair of optional joining devices 50, 55 can be seen to be located on each of said first and second sidewalls 30, 35 respectively. The joining devices 50, 55 may be used to releasably attach multiple carton holders 10 to one another in a horizontal row. Such attachment may improve the stability of the carton holders 10. Although the joining device 50, 55 are shown to be of tongue and groove construction in FIGS. 1–4, other types of attachment means are also possible. Additionally, a fewer or greater number of joining devices 50, 55 may also be employed.

While not required, a stop 60 (FIGS. 2 and 4) may be provided on the base 25 to assist in alignment of the carton 15 within the carton holder 10. Although the stop 60 is shown to protrude upward from a back portion of the base 25, the stop may alternatively be placed on a front portion thereof. Additionally, in certain embodiments of the present invention (described below) it may be possible to locate a stop 60 on the underside of the top wall 20, either in place of, or in addition to a stop on the base 25. However, it should be realized that if a stop 60 is employed on both the top wall 20 and the base 25, the stops should both be located on either the front or back portions thereof to allow for proper insertion of the carton 15.

The curved shape of the sidewalls 30, 35 of this particular embodiment of the carton holder 10 of the present invention can be seen especially by reference to FIG. 3. With reference also to FIG. 1, it may be appreciated that the curved, narrow shape of the sidewalls 30, 35 allows for ample protrusion of the carton 15 from the carton holder 10, thereby providing a gripping area and facilitating easy insertion or removal of the carton by a user of the carton holder. Other embodiments are also possible, however. For example, the sidewalls 30, 35 need not be curved, the top wall 20 may be of same or great size than the base 25, and/or the sidewalls may be of equal width to the top wall and/or base. However, it is preferred that at least a portion of the carton 15 be allowed to protrude from the carton holder 10 to assist in gripping the carton.

The hollow construction of the carton holder 10 is particularly illustrated by the cross-section of FIG. 4. In this embodiment, it can be seen that the top wall 20, base 25, sidewalls 30, 35, dispenser connector 40, and joining devices 50, 55 are formed as a single unitary structure, preferably by injection molding or similar means. An optional stop 60 is shown to protrude upward from the base 25.

Figure 5:
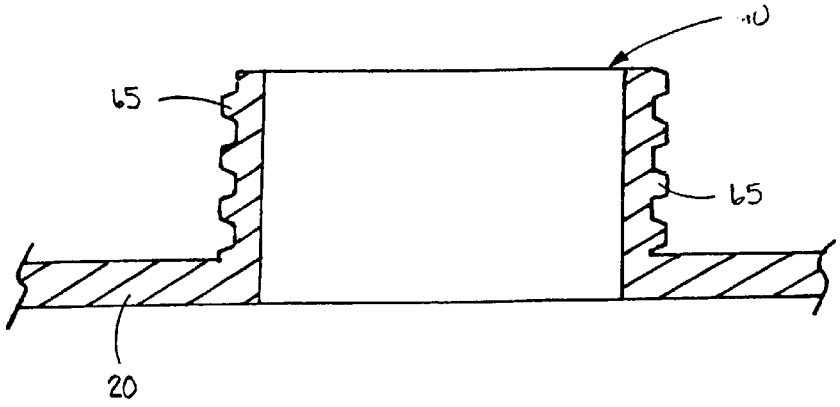
FIG. 5 is an enlarged view of the cross-section of a dispenser connector visible in FIG. 4.

An enlarged view of the dispenser connector 40 shown in FIG. 4 may be seen by reference to FIG. 5. In this particular embodiment, the dispenser connector 40 is shown to have external threads 65 for acceptance of an internally threaded portion of a pump or other device for removing and dispensing the contents of the carton 15. Alternatively, the dispenser connector 40 may be internally threaded (not shown) and the connecting portion of the pump or other dispensing device externally threaded.

Figure 6:
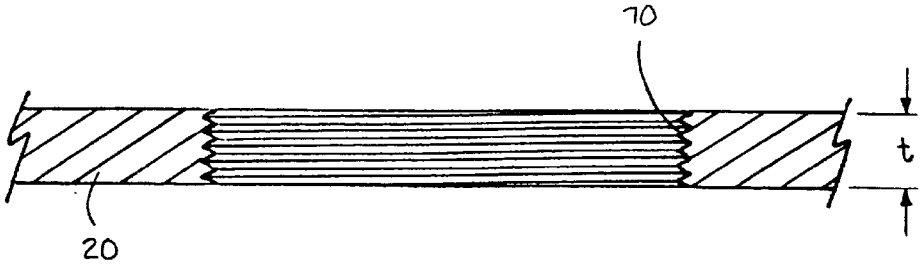
FIG. 6 is an enlarged cross-section, showing an alternate structure for allowing the connection of a dispensing device to a top wall of the carton holder of the present invention.

As shown in FIG. 6, it is also possible that the top wall 20 of the carton holder 10 may be made to have a greater thickness t, thereby allowing internal threads 70 to be formed in an opening therein for accepting an externally threaded pump or similar dispersing device. In this embodiment, a protruding dispenser connector 40 is not required, but may still be employed.

Figure 7:
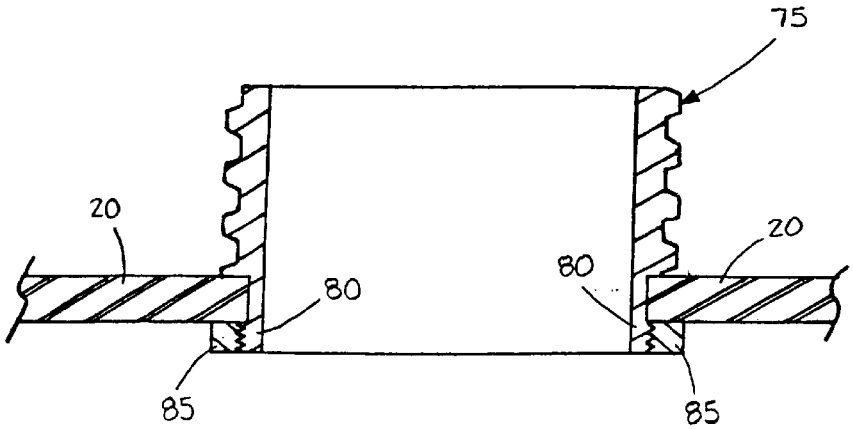
FIG. 7 is an enlarged view, depicting an alternate method of attaching a dispenser connector, similar to that of FIGS. 1–5, to the carton holder of the present invention.

It is also possible to manufacture the carton holder 10 of separate components. For example, as can be seen in FIG. 7, a dispenser connector 75 may be attached to the top wall 20 of the carton holder 10 after molding. In this embodiment, the dispenser connector 75 may be provided with a lower portion 80 of reduced diameter to protrude through an opening in the top wall 20, where it may be fastened thereto by a retainer 85, such as a nut or retaining clip, for example. Alternatively, a dispenser connector (not shown) may be threaded into a threaded opening provided in the top wall 20. Left and right-handed threads may be employed to prevent loosening of the dispenser connector if a threaded dispenser is attached thereto.

Similarly to the dispenser connectors discussed above, the joining devices 50, 55 may be separately attached to the sidewalls 30, 35 of the carton holder 10. The joining devices 50, 55 may be affixed, for example, by adhesive bonding, welding, or other known means.

The present invention also contemplates that each of the dispenser connectors 40, 70, 75 illustrated may possess means for attachment other than the threads 65, 70 shown in FIGS. 1–7. Any of a variety of known retaining devices may be used to fasten the pump or other dispensing device to the particular dispenser connector of the carton holder 10. For purposes of illustration, and not limitation, these retaining devices may include: a spring-loaded ball and retainer; hook or clasp means; a barb; clamping means; or a press fit.

In the embodiment of the carton holder 10 shown in FIGS. 1–4, the dispenser connector 40 or other means provided for connection of the carton holder to a dispensing device, is preferably located on the top wall 20 as to allow alignment of the dispenser connector with a perforated or otherwise weakened section on the top of the carton 15 when the carton is properly located in the carton holder. Such weakened sections are commonly provided on foodstuff cartons for allowing a suction tube or other portion of a dispensing device to communicate with the contents located therein. Although, in the embodiment of the carton holder 10 illustrated in FIGS. 1–4 the dispenser connector 40 is shown to be substantially in the middle of the top wall 20, it should be noted that the dispenser connector may be located anywhere thereon to coincide with the location of the weakened section of the corresponding carton 15.

Figure 8:
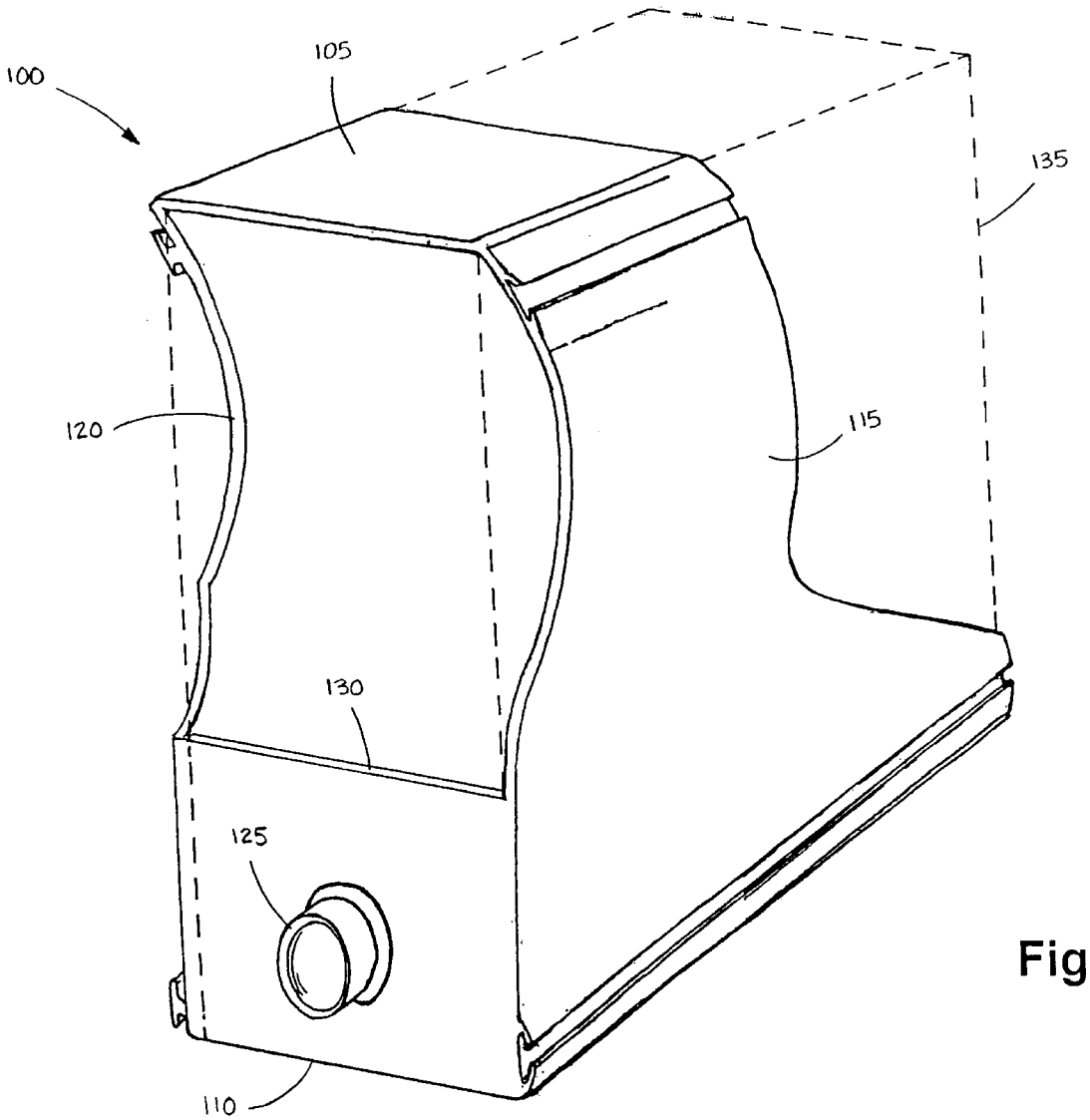
FIG. 8 is an alternate embodiment of the carton holder of the present invention, wherein a carton is visible therein (in phantom), and wherein the carton holder is designed to allow dispensing of the contents of a carton through a front portion of the carton holder.

An alternate embodiment of a carton holder 100 of the present invention is depicted in FIG. 8. This embodiment may be similar in appearance to the embodiment of the carton holder 10 illustrated in FIGS. 1–4. However, rather than providing for removal of the contents of a carton 135 from the top, the carton holder 100 of this embodiment of the present invention provides for removal and dispensing of the contents from the front.

This embodiment of the carton holder 100 can also be seen to be substantially a hollow frame. Like the embodiment of the carton holder 10 of FIGS. 1–4, the carton holder 100 also has a top wall 105, a base 110, and first and second sidewalls 115, 120. A partial front wall 130 is shown for locating a dispenser connector 125, although in another embodiment (not shown) it is contemplated that a front wall may extend fully between the base 110 and the top wall 105.

The carton holder 100 is designed to receive a carton 135 having a weakened section located to align with the dispenser connector 125 as shown. With this orientation, it is possible to dispense the contents of the carton 135 through the front portion of the carton holder 100, rather than through the top. In this manner, the contents of the carton 135 nay be removed via the force of gravity alone, and no pump is required. The disperser connector 125 may simply be coupled to a spigot, tap, or similar valve having a protruding suction tube or other structure capable of penetrating the weakened section of the carton 135 and communicating with the contents therein.

In this embodiment, it is also possible to design the top wall 105, the front wall 130, and the base 110 or a structure attached thereto, such that the carton 135 may reside in a position tilted toward the front wall when placed in the carton holder 100. In this orientation (not shown), the contents of the carton 135 may be caused to flow toward the dispenser connector 125 by the force of gravity, thereby promoting improved flow therefrom.

The alternate embodiments described above in regard to the shape and size of the sidewalls and base, multi-piece construction, dispenser connector, and connection of a dispensing device, are equally applicable to this embodiment of the carton holder 100. However, it should be noted that secure attachment of the dispensing device to the dispenser connector 125 is more critical to this embodiment of the carton holder 100, as the contents of the carton 135 will obviously flow out of any leak therebetween.

Figure 9:
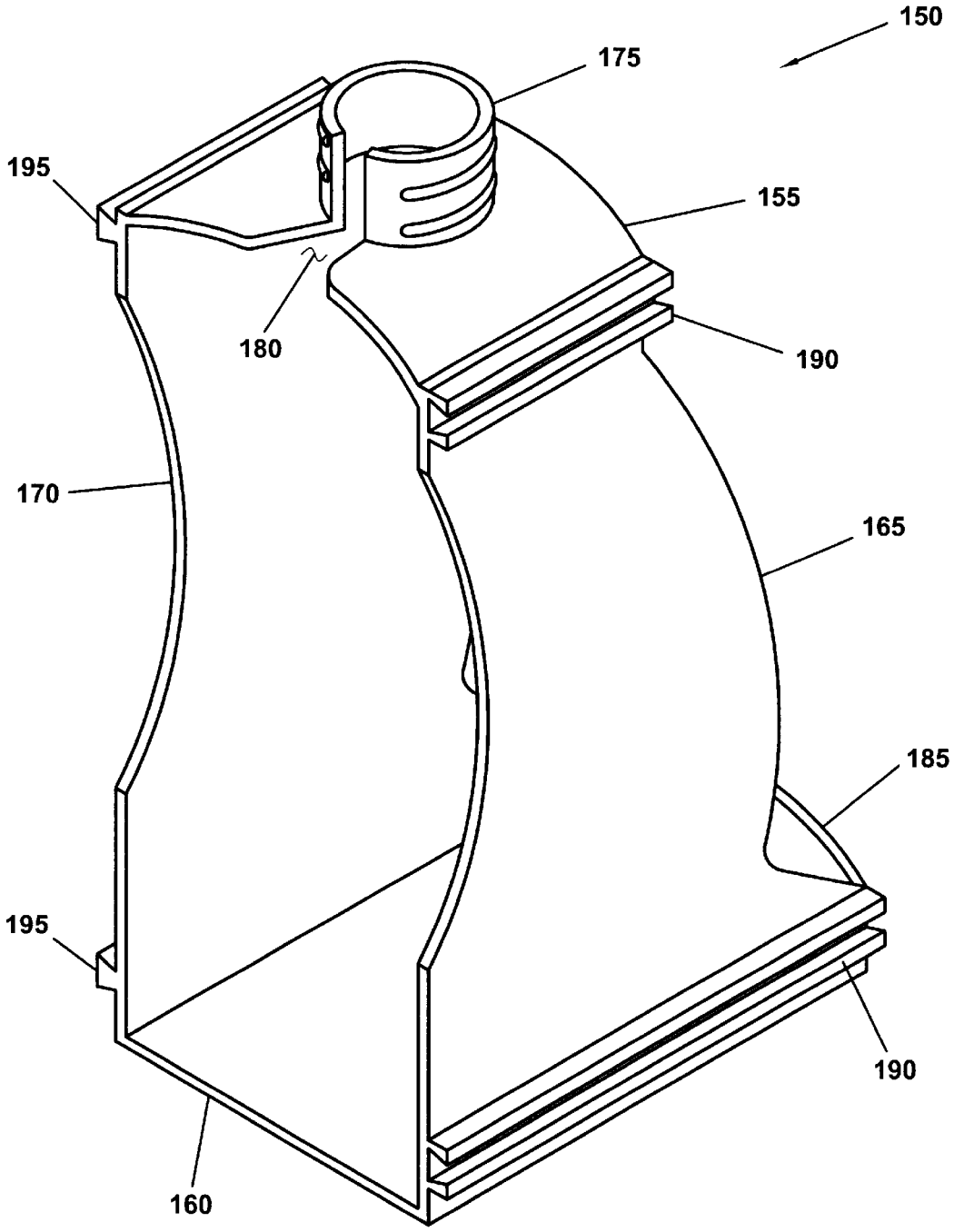
FIG. 9 depicts another embodiment of the carton holder of the present invention, wherein a dispenser connector portion is adapted for receiving a dispensing device attached to a carton, as the carton is slidably inserted into the carton holder.
Figure 10:
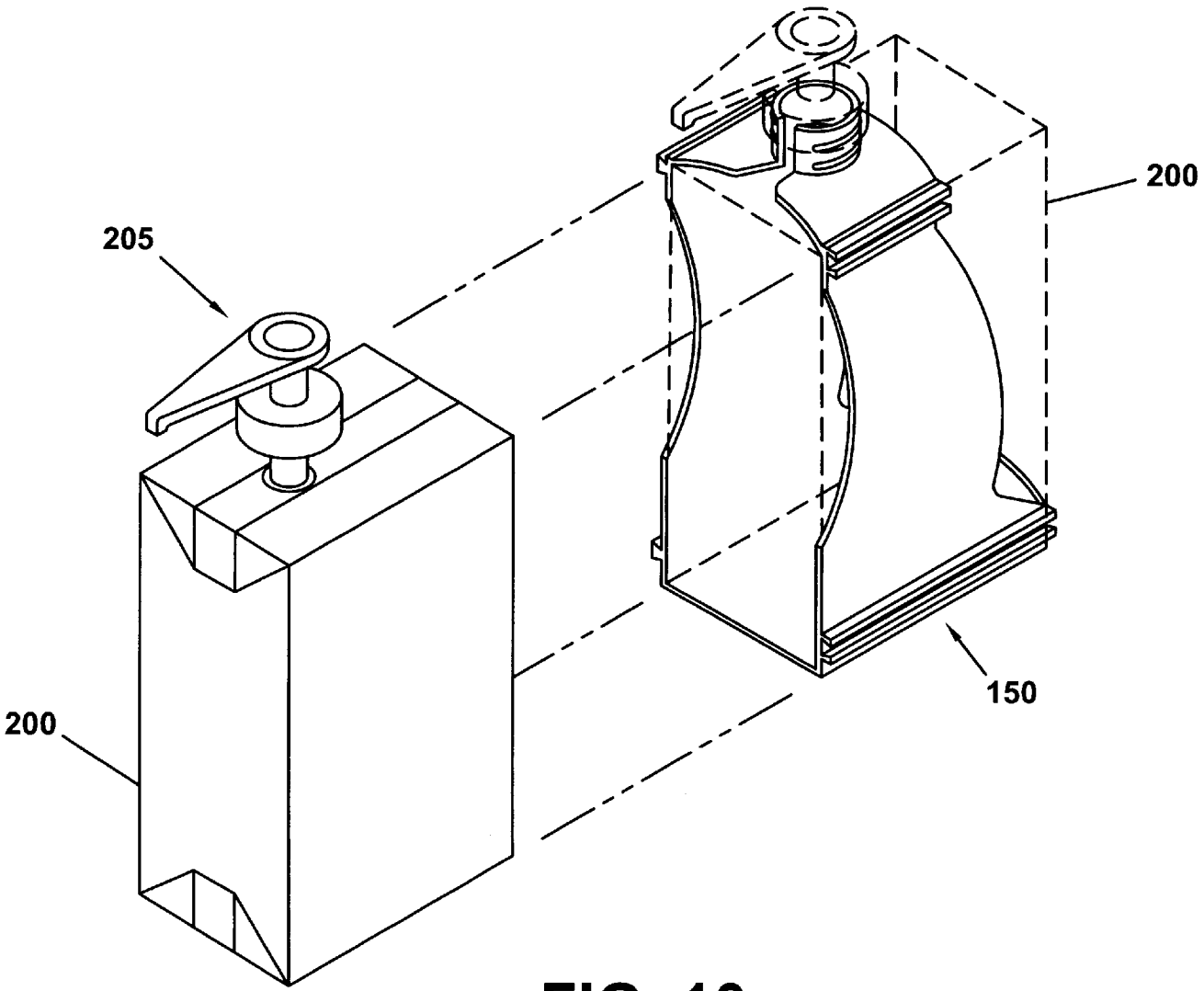
FIG. 10 shows the insertion of a carton into the carton holder of FIG. 9.

Still another embodiment of the carton holder 150 may be seen by reference to FIGS. 9–10. The carton holder 150 of FIGS. 9–10 is shown to be similar to the carton holder 10 depicted in FIGS. 1–4. The carton holder preferably has a top 155, a base 160, first sidewall 165 and a second sidewall 170. Preferably, the top 155 and base 160 are substantially parallel, as are the first sidewall 165 and second sidewall 170.

A dispenser connector 175 protrudes from the top 155 of the carton holder 150 for receiving a dispensing device. Unlike the embodiment of FIGS. 1–4, however, the dispenser connector 175 of this embodiment possesses an opening 180, which is adapted to allow the slidable passing of a portion of a dispensing device during insertion of a carton 200 (FIG. 10) into the carton holder 150. In this embodiment, it is contemplated that the dispensing device 205 (FIG. 10) has already been inserted into the carton 200, or may be supplied as a portion of the carton.

FIG. 10 illustrates how the carton 200 may be inserted into the carton holder 150 in this embodiment of the present invention. The carton 200 may be inserted from the front of the carton holder 150 until it contacts a stop 185 that is located at the rear thereof and preferably attached to the base 160. Alternatively, the stop 185 could be located at the front of the carton holder 150 and the opening 180 located at the rear of the dispenser connector 175, thereby allowing the carton 200 to be inserted from the rear. The top 185 may also extend downward from the top 155 in lieu of the location shown, or optionally, may exist in both locations. The stop 185 is located to ensure that the dispensing device 205 protruding from the carton 200 is properly aligned with the dispenser connector 175 when the carton is properly inserted into the carton holder 150.

After insertion of the carton 200, the dispensing device 205 is attached to the dispenser connector 175 by whatever attachment means are provided. In FIGS. 9–10, the dispenser connector 175 is shown to have threads for attachment of the dispensing device 205, however, as discussed above, other attachment means may also be provided.

The carton holder 150 is also shown to possess a pair of optional joining devices 190, 195 on each of the first and second sidewalls 165, 170. The joining devices 165, 170 nay be used to releasably attach multiple carton holders 150 to one another in a horizontal row. Such attachment may improve the stability of the carton holders 150. Although the joining devices 165, 170 are shown to be of substantially tongue and groove construction in FIGS. 9–10, other types of joining means are also possible. Additionally, a fewer or greater number of joining devices 165, 170 may also be employed.

Figure 11:
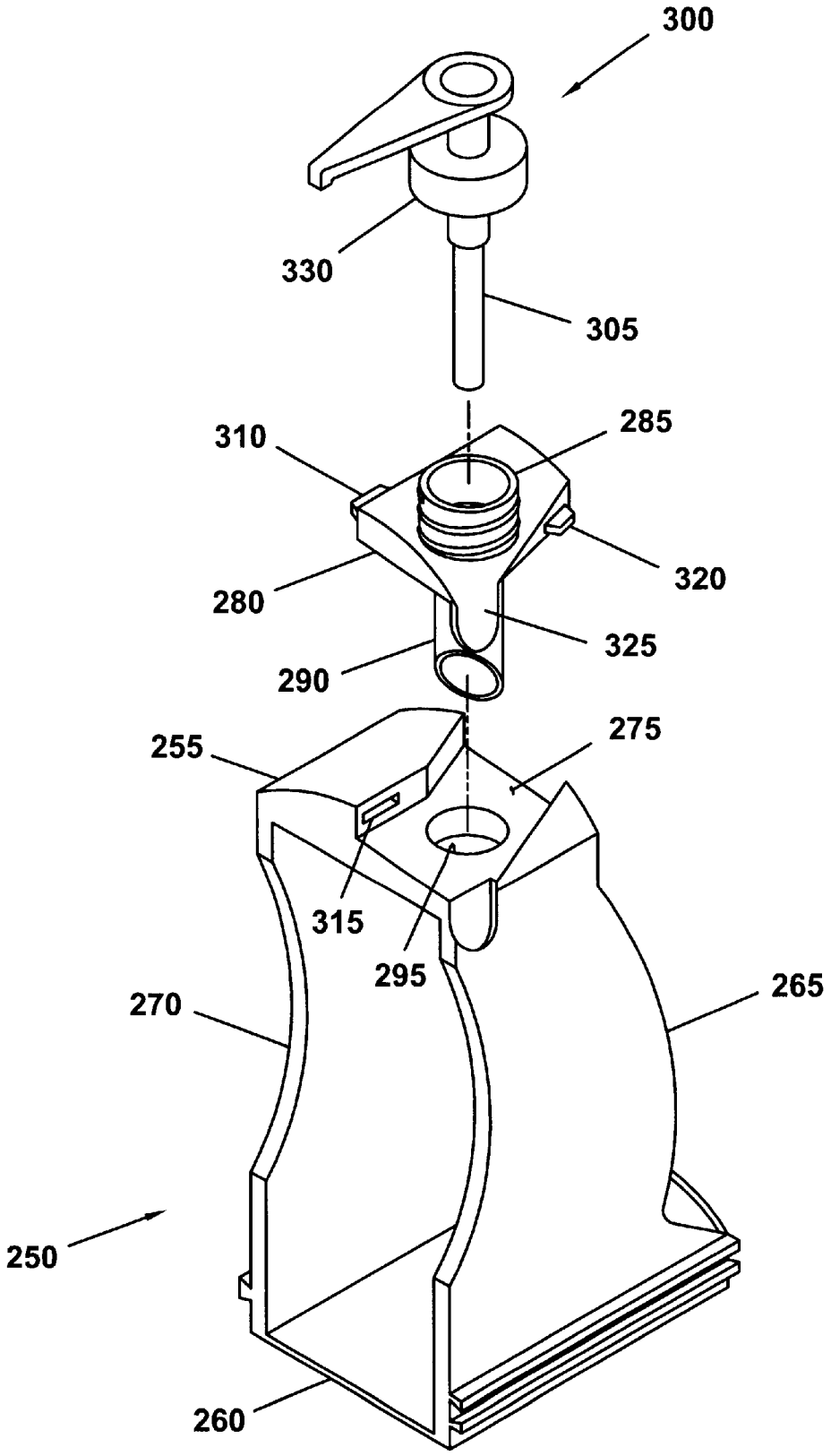
FIG. 11 illustrates an alternate embodiment of the carton holder of the present invention, wherein a dispenser connector and a carton piercing device are attached to a removable section of the carton holder.

Yet another embodiment of a carton holder of the present invention is shown in FIG. 11. The shape of the carton holder 250 can be seen to be comparable to the carton holder 10 depicted in FIGS. 1–4, and 150 shown in FIGS. 9–10. The carton holder 250 preferably has a top 255, a base 260, a first sidewall 265 and a second sidewall 270. Preferably, the top 255 and base 260 are substantially parallel, as are the first sidewall 265 and second sidewall 270.

The top 255 of the carton holder 250 is shown to have a shaped receptacle 275 for receiving a separate dispenser connector unit 280. The dispenser connector unit 280 preferably contains a dispenser connector 285 and also an opening conduit 290. The opening conduit 290 preferably extends from a bottom surface of the dispenser connector unit 280, and is designed to pass through the top 255 of the carton holder 250 via a passageway 295, thereafter penetrating and entering a weakened section of a carton (not shown) placed within the carton holder. The dispenser connector 275 preferably protrudes from a top surface of the dispenser connector unit 280 for connection to a dispensing device 300.

Preferably, the dispenser connector unit 280 is shaped to fit within a portion of the shaped receptacle 275, such that the dispenser connector unit may thereafter be rotated into a secured relationship with the top 255 of the carton holder 250. Securing of the dispenser connector unit 280 may be accomplished by causing a first tab 310 to enter a corresponding first slot 315 and a second tab 320 to enter a corresponding second slot (not shown) during rotation thereof. A fewer or greater number of tabs and corresponding slots may be employed for this purpose, as may other types of securing devices. A projection 325 extending downward from the dispenser connector unit 280 may further assist in locating and securing the dispenser connector unit within the shaped receptacle 275.

Once the dispenser connector unit 280 has been secured to the top 255 of carton holder 250, thereby penetrating the carton located therein, the dispensing device 300 may be connected to the dispenser connector 285. The dispensing device 300 preferably has a transport conduit 305 that passes through the opening conduit 290 of the dispenser connector unit 280 and extends downward into the contents of the carton, thereby facilitating removal of the contents therein by the dispensing device. The dispensing device 300 also preferably possesses a connecting element 330 for securing the dispensing device to the dispenser connector 285. Although a threaded dispenser connector 275 is shown in this embodiment, other connection means may also be used as discussed above.

While certain embodiments of the present invention are described in detail above, the scope of the invention is not to be considered limited by such disclosure, and modifications are possible without departing from the spirit of the invention as evidenced by the following claims.

What is claimed is:

1. A holding structure for receiving a carton of flowable material, said structure comprising:

a substantially hollow frame having a top wall, a base, and at least two sidewalls; and a connector for permitting the releasable attachment of a dispensing device to said frame;

wherein said connector is located to align with a dispensing location on said carton when said carton is properly located within said holding structure.

2. The holding structure of claim 1, further comprising a stop located on one or more of said top wall, said base, or said side walls, for assisting in the locating of said carton therein.

3. The holding structure of claim 1, wherein said connector is integral to at least one wall of said holding structure.

4. The holding structure of claim 3, wherein said connector protrudes outward from said at least one wall and is externally threaded.

5. The holding structure of claim 3, wherein said connector protrudes outward from said at least one wall and is internally threaded.

6. The holding structure of claim 3, wherein said connector comprises an internally threaded hole through said at least one wall.

7. The holding structure of claim 1, wherein said connector is a non-integral component affixed to said at least one wall of said holding structure.

8. The holding structure of claim 7, wherein a portion of said connector passes through an opening in said at least one wall and is affixed thereto by a retaining device.

9. The holding structure of claim 7, wherein a portion of said connector threads into an opening in said at least one wall.

10. The holding structure of claim 1, wherein said connector has a slot for allowing the passage of a portion of a dispensing device during insertion of a carton.

11. The holding structure of claim 1, wherein said at least two sidewalls are designed to allow the gripping of a portion of said carton after said carton is inserted therein.

12. The holding structure of claim 1, further comprising a joining apparatus affixed to at least one of said side walls, said joining apparatus for permitting the releasable joinder of multiple holding structures in a horizontal row.

13. The holding structure of claim 1, wherein said holding structure is adapted to cause the contents of a carton located therein to flow toward the location of said connector.

14. A carton holder for receiving a carton of flowable material, said structure comprising:

a substantially hollow frame having a top wall, a base, and at least two side walls; and a connector, located on at least one of said walls, for permitting the releasable attachment of a dispensing device;

wherein said top wall, said base, and said at least two sidewalls form substantially a parallelepiped with at least one open side; and wherein said connector is located to align with a dispensing location on said carton when said carton is properly located within said structure.

15. The carton holder of claim 14, further comprising a front wall extending at least partially upward from said base toward said top wall.

16. The carton holder of claim 14, further comprising a stop located on one or more of said top wall, said base, or said at least two sidewalls, for assisting in the locating of said carton therein.

17. The carton holder of claim 14, wherein said connector is integral to said carton holder.

18. The carton holder of claim 17, wherein said connector protrudes outward from said carton holder and is externally threaded.

19. The carton holder of claim 17, wherein said connector protrudes outward from said carton holder and is internally threaded.

20. The carton holder of claim 17, wherein said connector comprises an internally threaded hole.

21. The carton holder of claim 14, wherein said connector is a non-integral component affixed to said carton holder.

22. The carton holder of claim 21, wherein a portion of said connector passes through an opening in at least one of said walls and is affixed thereto by a retaining device.

23. The carton holder of claim 20, wherein a portion of said connector threads into an opening in at least one of said walls.

24. he holding structure of claim 14, wherein said connector has a slot for allowing the passage of a portion of a dispensing device during insertion of a carton.

25. The carton holder of claim 14, wherein said at least two sidewalls are designed to allow the gripping of a portion of said carton after said carton is inserted therein.

26. The carton holder of claim 14, further comprising a joining apparatus located on at least one of said side walls, said joining apparatus for permitting the releasable joinder of multiple carton holders in a horizontal row.

27. The carton holder of claim 14, wherein said carton holder is adapted to cause the contents of a carton located therein to flow toward the location of said connector.

28. A method of retaining a carton of flowable material and dispensing the contents thereof, said method comprising:

providing a substantially hollow frame for receiving said carton;

providing a connector for permitting the releasable connection of a dispensing device to said frame;

locating said carton within said frame so that a dispensing location resident on said carton is aligned with said connector;

penetrating a material covering said dispensing location on said carton; and attaching a dispensing device to said connector so that said dispensing device is in communication with the contents of said carton;

whereby the contents of said carton may thereafter be dispensed substantially without disturbing said carton.

29. The method of claim 28, wherein said dispensing device is adapted to penetrate said material covering said dispensing location on said carton and communicate with the contents therein.

30. The method of claim 28, wherein said material covering is penetrated by a portion of a non-integral component of said frame, said non-integral component adapted for releasable connection to said frame and a dispensing device.

31. The method of claim 28, wherein the contents of said carton are dispensed through a top portion of said carton.

32. The method of claim 28, wherein the contents of said carton are dispensed through any of the side portions of said carton.

33. The method of claim 28, wherein the contents of said carton are dispensed through a bottom portion of said carton.

34. The method of claim 28, wherein the contents of said carton are caused to be dispersed by pumping.

35. The method of claim 28, wherein the contents of said carton are caused to be dispensed by the force of gravity.

36. The method of claim 28, further comprising the releasable joinder of two or more of said frames.

37. The method of claim 28, further comprising causing the contents of said carton to flow toward the location of said connector when said carton is located within said frame.

38. The method of claim 28, further comprising providing a slot in said connector for allowing the passage of a portion of a dispensing device during insertion of a carton.

39. The method of claim 28, wherein the steps thereof take place in the order shown.

* * * * *